US006002418A

United States Patent [19]

Yoneda et al.

[11] Patent Number: 6,002,418

[45] Date of Patent: Dec. 14, 1999

[54] THERMAL HEAD

[75] Inventors: Junichi Yoneda, Shizuoka; Makoto Kashiwaya, Kanagawa; Taihei Noshita, Shizuoka, all of Japan

[73] Assignee: Fuji Photo Film Co., Ltd., Kanagawa, Japan

[21] Appl. No.: 09/060,819

[22] Filed: Apr. 16, 1998

[30] Foreign Application Priority Data

Apr. 16, 1997 [JP] Japan ..... 9-098701

[51] Int. Cl.[6] ..... B41J 2/335

[52] U.S. Cl. ..... 347/203

[58] Field of Search ..... 347/200, 203; 427/122, 249; 428/908.8

[56] References Cited

U.S. PATENT DOCUMENTS 5,238,705 8/1993 Hayashi et al. ..... 427/122

FOREIGN PATENT DOCUMENTS 61-53955 11/1986 Japan ..... B41J 3/20

7-132628 5/1995 Japan ..... B41J 2/335

*Primary Examiner*—Huan Tran

*Attorney, Agent, or Firm*—Sughrue, Mion, Zinn, Macpeak & Seas, PLLC

[57] ABSTRACT

The improved thermal head comprises heating elements which were provided with heating histories to previously change their resistance values by predetermined values; and a carbon-based protective layer which was formed after the heating elements were provided with the heating histories. The invention provides the thermal head in which corrosion and wear of the protective film, and the resistance variation of the heating elements due to thermal recording were significantly reduced, and which has a sufficient durability and stability with the passage of time to perform thermal recording of high-quality images in a consistent manner over an extended period of operation.

17 Claims, 4 Drawing Sheets

THERMAL HEAD

BACKGROUND OF THE INVENTION

This invention relates to the art of thermal heads for thermal recording which are used in various types of printers, plotters, facsimile, recorders and the like as recording means.

Thermal materials comprising a thermal recording layer on a substrate of a film or the like are commonly used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a heater (glaze), in which heating elements comprising heat-generating resistors and electrodes, used for heating the thermal recording layer of a thermal material to record an image are arranged in one direction (main scanning direction) and, with the glaze urged at small pressure against the thermal material (thermal recording layer), the two members are moved relative to each other in the auxiliary scanning direction perpendicular to the main scanning direction, and the heating elements of the respective pixels on the glaze are heated by energy application in accordance with image data to be recorded which were supplied from an image data supply source such as MRI or CT in order to heat the thermal recording layer of the thermal material and form color, thereby accomplishing image reproduction.

In thermal recording, density unevenness on the recorded image brings about a reduction in the quality of the finished image, which may cause an important problem in applications requiring high quality image recording. Especially the aforementioned medical application requires high quality images. Density unevenness also prevents image observation which will cause an important problem leading to an erroneous diagnosis. It is thus required that the thermal head is capable of recording high quality thermal images without density unevenness and having a reduced deterioration with the passage of time over an extended period of time.

Primary causes of the deterioration of the thermal head with the passage of time include variation in the properties of heating elements due to heat generation, and wear and corrosion (or wear due to corrosion) of the glaze.

A heating element of the thermal head usually comprises a heat-generating resistor and a pair of electrodes which energize the heat-generating resistor. The resistance value of the heating element varies with the time for heat generation and the energy for heat generation. Hence, the more the resistance value decreases, the more the amount of heat generation increases. The temperature of the heating element associated with the supplied energy for heat generation increases by the reduced resistance value, which brings about an increase in the image density.

The heating history which shows the total amount of heat generation, or the ratio of heat generation for the image recording performed is inherently different in each of the heating elements of the thermal head mounted in the thermal recording apparatus. Then, the amount of resistance variation is also different in each of the heating elements. Therefore, in the course of image recording, differences in the amount of resistance variation are produced among the respective heating elements, which gives rise to density unevenness on the recorded image in association with the differences.

The thermal head and the thermal material are moved relative to each other to perform recording, with the glaze thereon urged at small pressure against the thermal material. A protective film is formed on the surface of the glaze of the thermal head in order to protect the heating elements and other components. It is this protective film that contacts the thermal material during thermal recording and the heat-generating resistors heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density unevenness will occur on the thermal image or a desired protective strength can not be maintained and, hence, the ability of the film to protect the heaters is impaired to such an extent that the intended image recording is no longer possible (the head has lost its function).

Particularly in the applications such as the aforementioned medical use which require multiple gradation images of high quality, the trend is toward adopting thermal films with highly rigid substrates such as polyester films and also increasing the setting values of recording temperature and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head so as to improve its durability, a number of techniques have been considered in order to improve the performance of the protective film. Among others, a carbon-based protective film (hereinafter referred to as a carbon protective layer) is known as a protective film excellent in resistance to wear and corrosion.

Thus, Examined Published Japanese Patent Application (KOKOKU) No. 61-53955 discloses a thermal head excellent in wear resistance and response obtained by forming a very thin carbon protective layer having a Vickers hardness of 4500 kg/mm$^2$ or more as the protective film of the thermal head.

Moreover, Unexamined Published Japanese Patent Application (KOKAI) No. 7-132628 discloses a thermal head which has a dual protective film comprising a lower silicon-based compound layer and an overlying diamond-like carbon layer, whereby the potential wear and breakage of the protective film are significantly reduced to ensure that high-quality image can be recorded over an extended period of time.

These carbon protective layers have a very high hardness and chemical stability, hence they exhibit sufficiently excellent properties to prevent wear and corrosion which may be caused by the sliding contact with thermal materials.

However, the carbon protective layers are not enough to resolve the aforementioned recording unevenness due to the resistance variation of the heating elements with the passage of time. It is also important the carbon protective layers have excellent properties in order to record high quality thermal images having a reduced deterioration with the passage of time over an extended period of time.

SUMMARY OF THE INVENTION

The present invention has been accomplished under these circumstances and has as an object providing a thermal head of which the variation in the resistance values of the heating elements and the wear or deterioration of the protective layer were reduced, and which is capable of consistently recording high quality thermal images over an extended period of time.

In order to achieve the above object, the invention provides a thermal head comprising:

heating elements which were provided with heating histories to previously change their resistance values by predetermined values; and a carbon-based protective layer which was formed after said heating elements were provided with said heating histories.

An amount of the resistance variation to be previously given to said heating elements by said heating histories is preferably in the range of from 0.1 to 5.0%, more preferably from 0.5 to 2.0%.

It is preferred that said heating histories are provided in blank recording by supplying a specified amount of heat generating energy for a specified period of time without recording on a thermal material.

Said carbon-based protective layer is preferably a carbon protective layer containing more than 50 atm % of carbon, more preferably a high-purity carbon protective layer.

Said carbon-based protective layer has preferably a Vickers hardness of 2000 kg/mm$^2$ or more, more preferably 2500 kg/mm$^2$ or more.

Said carbon-based protective layer has preferably a thickness of from 1 to 20 $\mu$m, more preferably from 2 to 10 $\mu$m.

It is further preferred that said thermal head further comprises at least one ceramic-based protective layer as a lower protective layer of said carbon-based protective layer on the side of the heating elements.

Said ceramic-based protective layer is preferably a protective layer made of a material selected from the group consisting of silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures of at least two of these materials, more preferably a protective layer made of a material selected from the group consisting of silicon nitride, silicon carbide, SIALON and mixtures of at least two of these materials.

Said lower protective layer has preferably a thickness of from 2 to 50 $\mu$m, more preferably from 4 to 20 $\mu$m.

Said carbon-based protective layer has preferably a thickness of from 0.1 to 5 $\mu$m, more preferably from 1 to 3 $\mu$m.

DETAILED DESCRIPTION OF THE INVENTION

The thermal head of the invention will now be described in detail with reference to the preferred embodiments shown in the accompanying drawings.

Figure 1:
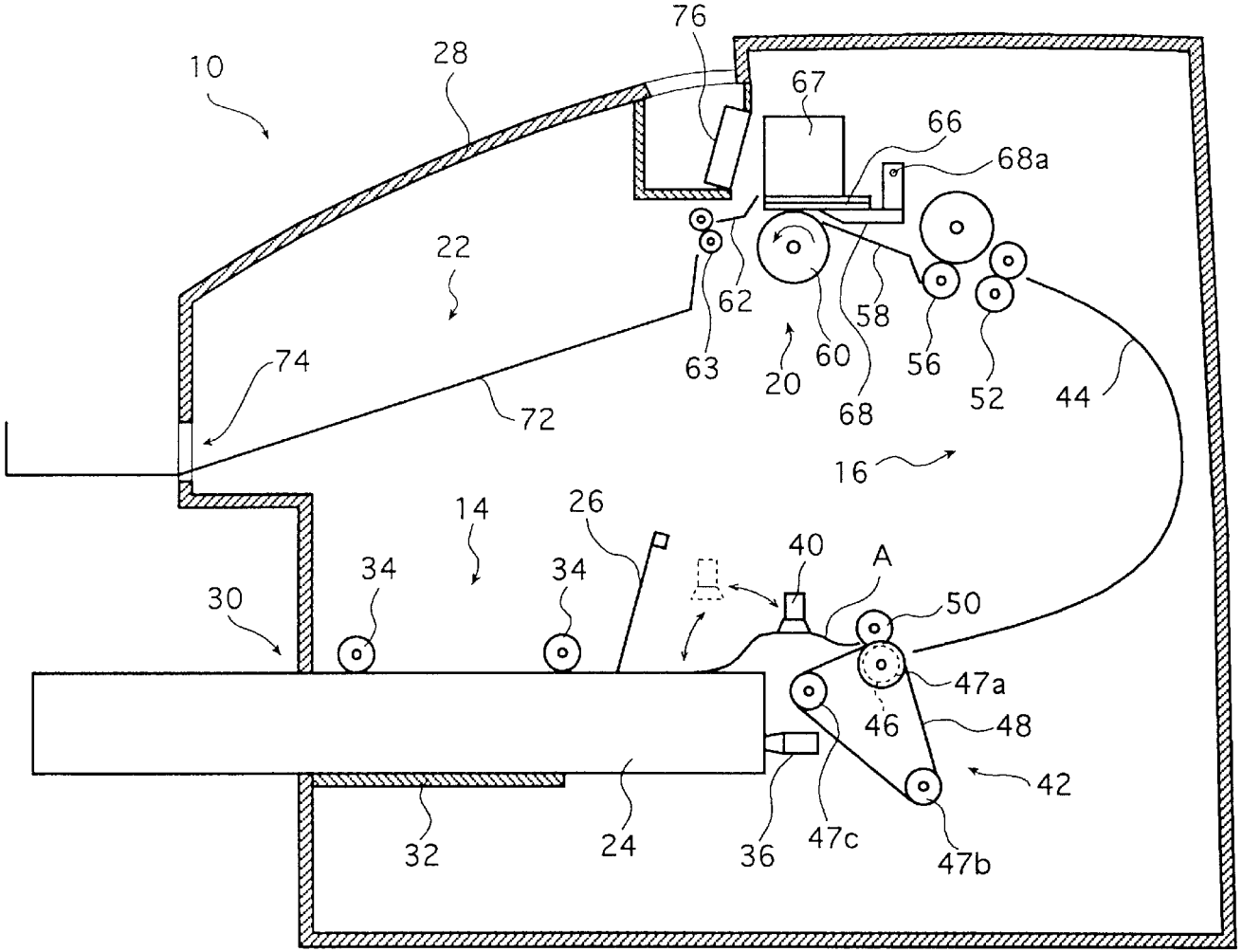
FIG. 1 shows the concept of an exemplary thermal recording apparatus using the thermal head of the invention.

FIG. 1 shows schematically an exemplary thermal recording apparatus using the thermal head of the invention.

The thermal recording apparatus generally indicated by 10 in FIG. 1 and which is hereinafter simply referred to as a "recording apparatus 10" performs thermal recording on thermal materials of a given size, say, B4 (namely, thermal materials in the form of cut sheets, which are hereinafter referred to as "thermal materials A"). The apparatus comprises a loading section 14 where a magazine 24 containing thermal materials A is loaded, a feed/transport section 16, a recording section 20 performing thermal recording on thermal materials A by means of a thermal head 66, and an ejecting section 22.

In the thus constructed recording apparatus 10, a thermal material A is taken out of the magazine 24 and transported to the recording section 20, where the thermal material A against which the thermal head 66 is pressed is transported in the auxiliary scanning direction perpendicular to the main scanning direction in which the heater (or the glaze) extends (normal to the papers of FIGS. 1 and 2) and in the meantime, the individual heating elements are actuated in accordance with image data on the image to be recorded to perform thermal recording on the thermal material A.

The thermal material A comprises a substrate of a resin film such as a transparent polyethylene terephthalate (PET) film, a paper or the like which are overlaid with a thermal recording layer.

Typically, such thermal materials A are stacked in a specified number, say, 100 to form a bundle, which is either wrapped in a bag or bound with a band to provide a package. As shown, the specified number of thermal materials A bundle together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown) for opening or closing the cover 26 of the magazine.

The feed/transport section 16 has the sheet feeding mechanism using a sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 comprises a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller pair, the sucker 40 releases the material, and the thus fed thermal material A is supplied by the transport means 42 into the regulating roller pair 52 as it is guided by the transport guide 44.

At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 as the result of transport by the transport means 42. The regulating roller pair 52 are first at rest. The forward end of the thermal material A stops here and is subjected to positioning.

When the forward end of the thermal material A reaches the regulating roller pair 52, the temperature of the thermal head 66 (the glaze) is checked and if it is at a specified level, the regulating roller pair 52 starts to transport the thermal material A, which is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of recording on thermal sheets of up to, for example, 356×432 size at a recording (pixel) density of, say, about 300 dpi. The head comprises a glaze (heater) in which heating elements performing thermal recording on the thermal material A are arranged in one direction, that is in the main scanning direction, and the cooling heat sink 67 is fixed to the thermal head 66. The thermal head 66 is supported on a support member 68 that can pivot about a fulcrum 68*a*.

The glaze of the thermal head 66 will be described in detail later.

It should be noted that the thermal head 66 of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

Figure 2:
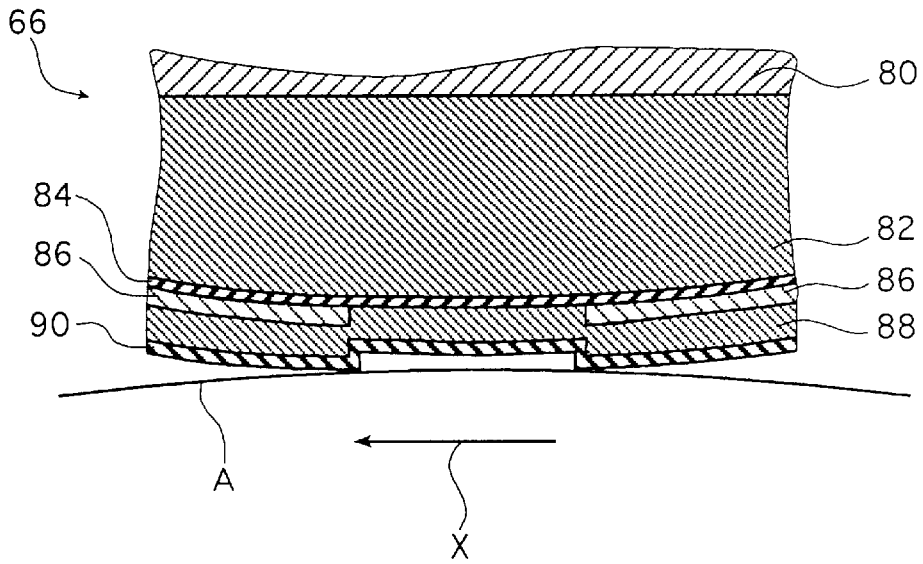
FIG. 2 is a schematic cross sectional view showing the structure of a heating element in the thermal head of the invention.

The platen roller 60 rotates at a specified image recording speed while holding the thermal material A in a specified position in the direction shown by the arrow in FIG. 1, and transports the thermal material A in the auxiliary scanning direction perpendicular to the main scanning direction (the direction shown by the arrow X in FIG. 2).

The cleaning roller pair 56 comprises an adhesive rubber roller made of an elastic material (upper side in the drawing) and a non-adhesive roller. The adhesive rubber roller picks up dirt and other foreign matter that has been deposited on the thermal recording layer of the thermal material A, thereby preventing the dirt from being deposited on the glaze or otherwise adversely affecting the image recording operation.

Before the thermal material A is transported to the recording section 20, the support member 68 in the illustrated recording apparatus 10 has pivoted to UP position so that the glaze of the thermal head 66 is in the standby position just before coming into contact with the platen roller 60.

When the transport of the thermal material A by the regulating roller pair 52 starts, said material is subsequently pinched by the cleaning roller pair 56 and transported as it is guided by the guide 58. When the forward end of the thermal material A has reached the record START position (i.e., corresponding to the glaze), the support member 68 pivots to DOWN position and the thermal material A becomes pinched between the glaze and the platen roller 60 such that the glaze is pressed onto the recording layer while the thermal material A is transported in the auxiliary scanning direction by means of the platen roller 60 and other parts as it is held in a specified position by the platen roller 60.

During this transport, the respective heating elements on the glaze are actuated imagewise to perform thermal recording on the thermal material A.

After the end of thermal recording, the thermal material A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

FIG. 2 is a schematic cross section of the glaze (heater) of the thermal head 66. As shown, to form the glaze, the top of a substrate 80 (which is shown to face down in FIG. 2 since the thermal head 66 is pressed downward against the thermal material A) is overlaid with a glaze layer (heat accumulating layer) 82 which, in turn, is overlaid with a heat-generating resistor 84 which, in turn, is overlaid with electrodes 86 which, in turn, is overlaid with a protective film and the like.

FIG. 2 illustrates a preferred embodiment in which the protective film is composed of two layers: a ceramic-based lower protective layer 88 superposed on the heat-generating resistor 84 and the electrodes 86 (or the heating element), and a carbon-based upper protective layer, for example, carbon protective layer 90 (preferably diamond-like carbon (DLC) protective layer) which is formed on the lower protective layer 88.

The thermal head 66 for use in the invention has essentially the same structure as known versions of thermal head except that the heating elements are provided with heating histories before the carbon protective layer 90 is formed and that the thermal head 66 has the carbon protective layer 90. Therefore, the arrangement of other layers and the constituent materials of the respective layers are not limited in any particular way and various known versions may be employed. Specifically, the substrate 80 may be formed of various electrical insulating materials including heat-resistant glass and ceramics such as alumina, silica and magnesia; the glaze layer 82 may be formed of heat resistant glass and heat resistant resins including polyimide resin and the like. In addition, the heat-generating resistor 84 and electrodes 86 may be formed of various materials used in known versions of thermal head and the materials thereof are not limited to any particular type. The specific examples of the materials for the heat-generating resistor 84 include heat-generating resistors such as Nichrome (Ni—Cr), tantalum metal, tantalum nitride, ruthenium oxide and polysilicon. The specific examples of the materials for the electrodes 86 include electrically conductive materials such as aluminum, gold, silver and copper.

As described above, the resistance value of each heating element of the thermal head varies in accordance with the heating history. The heating history is inherently different in each of the heating elements of the thermal head mounted in the thermal recording apparatus, so the amount of resistance variation is also different in each of the heating elements, which bring about with the passage of time differences in the amount of resistance variation among the heating elements. The recorded image will have thus density unevenness in accordance with the differences.

Figure 3:
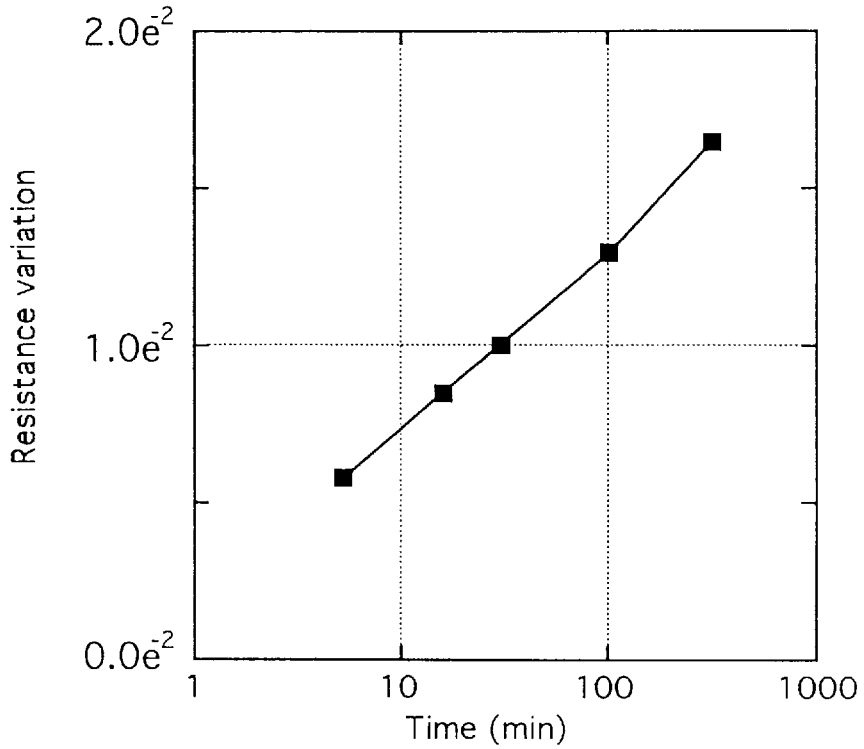
FIG. 3 is a graph showing an example of the relationship between the resistance variation of the heating elements of the thermal head and the logarithm of the time for heat generation.

FIG. 3 shows a graph of an example of the relationship between the resistance variation of the heating elements of the thermal head and the time for heat generation in blank recording, that is, when a specified energy for heat generation (145 $mJ/mm^2$) was supplied to the thermal material A without recording. It should be noted that the rate of resistance variation when recording is less than in blank recording, because the temperature of the glaze does not increase beyond a certain extent by the radiating effect from the glaze to the thermal material A.

As shown in FIG. 3, the resistance variation of the heating elements in the thermal head when a specified energy was supplied is approximately proportional to the logarithm of the time for heat generation. In other words, the initial resistance variation of the heating elements is large, but decreases exponentially with the passage of time, according as the total amount of heat generation increases.

Therefore, using a method in which a specified energy for heat generation is supplied to all the heating elements of the thermal head before use for a specified period of time, all the heating elements are provided with specified uniform heating histories to previously change the resistance values thereof by specified amounts, whereupon the subsequent resistance variation, hence the differences in the resistance variation among the respective heating elements can be significantly reduced.

In the thermal head 66 of the invention, all of the heating elements (including the heat-generating resistors 84 and the electrodes 86) are provided with specified heating histories to previously anneal and crystallize the heat-generating resistors 84, so that a uniform resistance variation is produced in all of the heating elements and resistance values of all of the heating elements are stabilized. The thermal head 66 of the invention comprises the heating elements having the thus stabilized resistance values, whereupon the differences in the resistance variation among the respective heating elements which may be caused by thermal recording can be reduced to thereby enable thermal recording of high-quality images without density unevenness in a consistent manner for an extended period of time. It should be noted that the heating histories are provided before the carbon protective layer 90 is formed.

According to the recording apparatus 10 of the invention, the resistance variation amount (heating history amount) previously given to the respective heating elements in the thermal head 66 is not limited to any particular value and can be determined for example using the graph of FIG. 3 or the like so that the amount of resistance variation which may be caused by the user's operation is in a specified range in which images having a specified quality can be ensured till the end of service life to be attained by the recording apparatus 10. In other words, the resistance variation amount to be previously given to the heating elements, that is, the energy for heat generation and the time for which the energy is supplied can be determined based on the relationship between the resistance variation amount which brings about density unevenness and the period of time during which maintenance of a specified image quality is desired.

It is necessary to determine the previous variation amount taking account of any deterioration of the thermal head which may result from the previous change of the resistance values of the respective heating elements in the thermal head 66.

The upper limit of the resistance variation of the heating elements is usually from 3 to 5%, hence the resistance variation amount to be previously given to the heating elements is preferably in the range of from 0.1 to 5%, especially from 0.5 to 2%, taking account of the productivity and production efficiency to be described below.

The temperature (surface temperature) of the thermal head when the heating elements of the thermal head 66 are provided with heating histories to change the resistance values thereof, hence the energy for heat generation supplied in said blank recording to provide the heating elements with the heating histories are not limited to any particular values.

If the temperature of the thermal head in this step is low however, it takes much time to sufficiently change the resistance values to exhibit the reduction effect on the resistance variation due to thermal recording, which adversely affects the productivity, production efficiency and other aspects. In addition, this is not practical.

The upper limit of the temperature when the heating histories are provided depend on the heat resisting temperature of the thermal head used.

The period of time for which the heating histories are provided can be determined based on FIG. 3 described above or the like prepared in accordance with the temperature of the thermal head (or energy for heat generation to attain this temperature) and the resistance variation amount to be achieved.

Heating elements of the thermal head are known to be available usually in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

As described above, the illustrated thermal head 66 according to a preferred embodiment comprises a protective film composed of the two layers: the carbon protective layer 90 and the lower protective layer 88. The presence of the lower protective layer enables acquirement of more preferred results in various aspects including resistance to wear, resistance to corrosion and resistance to corrosion wear. A thermal head having a higher durability and a long service life can be thus realized.

The lower protective layer 88 to be formed on the thermal head 66 of the invention may be formed of any known materials as long as they have sufficient heat resistance, corrosion resistance and wear resistance to serve as the protective film of the thermal head. Preferably, the ceramic-based lower protective layer 88 is illustrated.

Specific materials include silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among others, silicon nitride, silicon carbide, SIALON are advantageously utilized in various aspects such as easy film deposition, reasonability in manufacturing including manufacturing cost, balance between mechanical wear and chemical wear. Additives such as metals may be incorporated in small amounts into the lower protective layer to adjust physical properties thereof.

Methods of forming the lower protective layer 88 are not limited in any particular way and known methods of forming ceramic films (layers) may be employed by applying the aforementioned thick-film and thin-film processes and the like.

The thickness of the lower protective layer 88 is not limited to any particular value but it ranges preferably from about 0.5 $\mu$m to about 50 $\mu$m, more preferably from about 2 $\mu$m to about 20 $\mu$m. If the thickness of the lower protective layer 88 is within the stated ranges, preferred results are obtained in various aspects such as the balance between wear resistance and heat conductivity (that is, recording sensitivity).

The lower protective layer 88 may comprise multiple sub-layers. In this case, multiple sub-layers may be formed of different materials or multiple sub-layers different in density may be formed of one material. Alternatively, the two steps may be combined to obtain sub-layers.

The thermal head of the invention is not limited to the one having the lower protective layer 88, but may have a one-layer protective film comprising only the carbon protective layer 90 which will be described below.

The thermal head 66 of the invention has the carbon protective layer 90 served as the protective film of the heat-generating resistor 84 and other parts.

The illustrated thermal head 66 uses the carbon (DLC) protective layer 90 as the carbon-based protective layer, but the invention is not limited thereto and the carbon-based protective layer is suitably a carbon protective layer containing more than 50 atm % of carbon, preferably a carbon protective layer comprising carbon and inevitable impurities, more preferably a high-purity carbon protective layer having extremely reduced or no inevitable impurities, for example the DLC protective layer. The inevitable impurities include residual gases in the vacuum chamber exemplified by oxygen and gases used during the process such as argon (Ar). The content of the gaseous components incorporated into the carbon protective layer is suitably as low as possible, preferably not more than 2 atm %, more preferably not more than 0.5 atm %. According to the invention, the components to be incorporated in addition to carbon to form the carbon-based protective layer include advantageously elements such as hydrogen, nitrogen and fluorine, and semi-metals and metals such as Si, Ti, Zr, Hf, V, Nb, Ta, Er, Mo and W. In the case of hydrogen, nitrogen and fluorine, the content thereof in the carbon-based protective layer is preferably less than 50 atm %, and in the case of the abovementioned semi-metals and metals such as Si, Ti and the like, the content thereof is preferably not more than 20 atm %.

We will now describe the carbon protective layer 90 as a typical example of the carbon-based protective layer, but it is to be understood that the description is also applied to other carbon-based protective layers.

The carbon protective layer 90 having a high hardness and chemical stability provides the thermal head 66 having high reliability over a prolonged period of time and of which the protective film is advantageously protected from wear and corrosion wear due to thermal recording.

In the thermal head 66 of the invention, the carbon protective layer 90 is formed after the heating elements are provided with the aforementioned heating histories.

As described above, the thermal head 66 of the invention comprises heating elements of which the resistance variation due to thermal recording was reduced by providing all the heating elements with the heating histories to thereby previously change the resistance values thereof.

This operation is usually performed after the thermal head is fabricated. According to the considerations by the inventors however, the heating history provided in such a high temperature for the fabricated thermal head having the protective layer brings about a change in properties or partial peeling-off of the carbon protective layer 90, which prevents appropriate thermal recording.

On the other hand, the thermal head 66 of the invention comprises the carbon protective layer 90 formed after the heating elements were provided with the heating histories. The carbon protective layer 90 having favorable and appropriate properties without change in properties or partial peeling-off and being excellent in wear resistance and chemical stability provides the thermal head 66 having high reliability over a prolonged period of time. In addition, density unevenness due to the resistance variation is extremely reduced by the heating elements provided with the heating histories, as described above.

It should be noted that the aforementioned lower protective layer 88 may be formed before or after providing said heating elements with the heating histories.

The carbon protective layer 90 in the thermal head 66 of the invention needs to have a sufficient hardness to serve as the protective film of the thermal head, although a higher hardness provides better performance. The hardness is preferably more than 2000 kg/mm$^2$, more preferably more than 2500 kg/mm$^2$, most preferably more than 3000 kg/mm$^2$ in terms of Vickers hardness.

If the hardness of the carbon protective layer 90 is within the stated ranges, preferred results can be obtained in various aspects including wear resistance.

Moreover, the thickness of the carbon protective layer 90 is not limited to any particular value but it ranges preferably from 0.1 $\mu$m to 5 $\mu$m, more preferably from 1 $\mu$m to 3 $\mu$m, in the case of the glaze having the lower protective layer 88 as shown in FIG. 2. In the case where the lower protective layer 88 is not formed, it ranges preferably from 1 $\mu$m to 20 $\mu$m, more preferably from 2 $\mu$m to 10 $\mu$m.

If the thickness of the carbon protective layer 90 is within the stated ranges, preferred results can be obtained in various aspects including the balance between wear resistance and heat conductivity.

Methods of forming the carbon protective layer 90 are not limited in any particular way and known thick- and thin-film processes may be employed. Preferred examples include the plasma-assisted CVD using a hydrocarbon gas as a reactive gas to form a hard carbon film and the sputtering of a carbonaceous material (e.g., sintered carbon or glassy carbon) as a target to form a hard carbon film.

Figure 4:
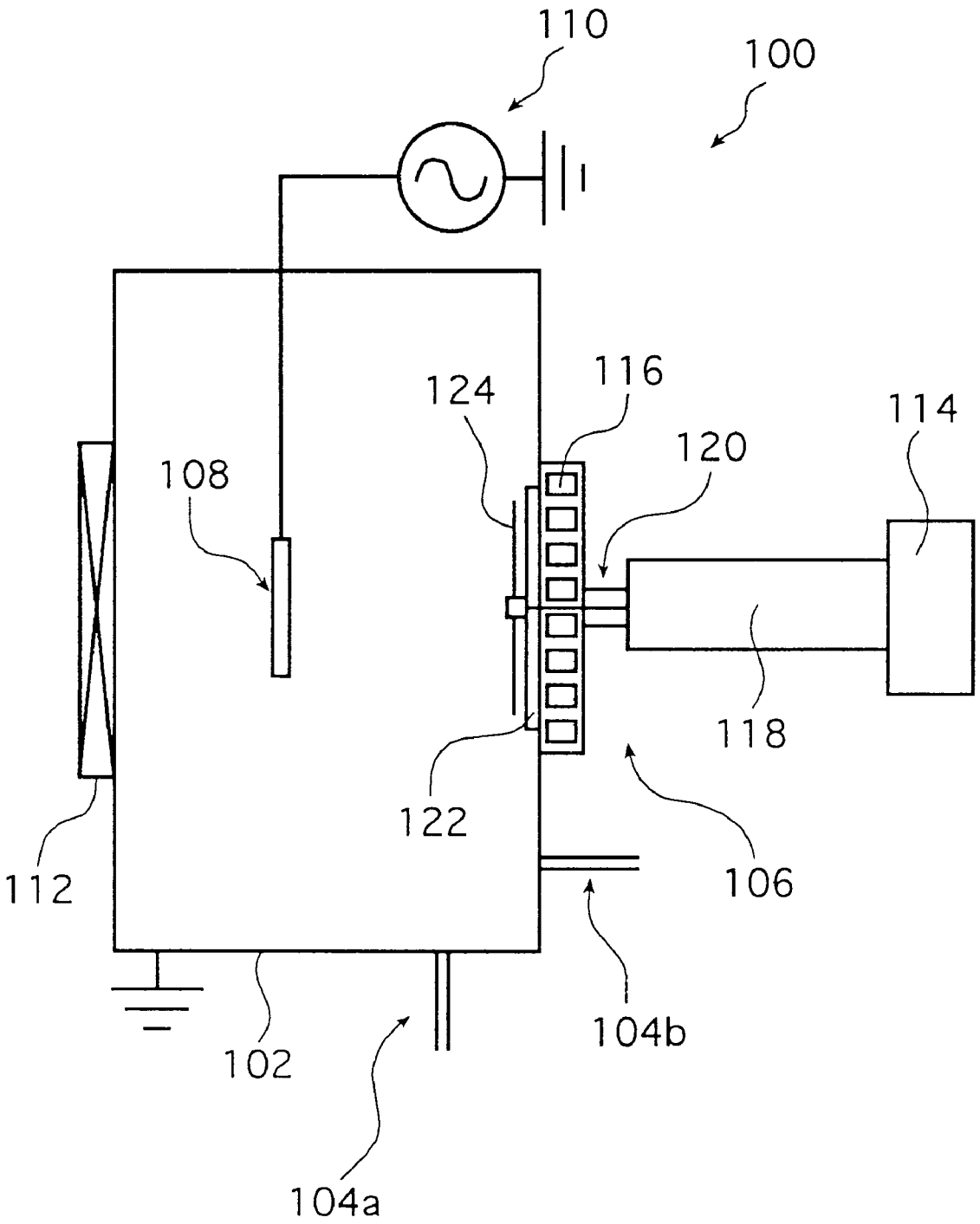
FIG. 4 shows the concept of an exemplary plasma-assisted CVD apparatus for forming a carbon protective layer on the thermal head of the invention.

FIG. 4 shows the concept of a plasma-assisted CVD apparatus to form the carbon protective layer 90. The CVD apparatus generally indicated by 100 comprises a vacuum chamber 102, a gas introducing section 104, plasma generating means 106, a substrate holder 108 and a substrate bias source 110 as the basic components.

The vacuum chamber 102 is preferably formed of a nonmagnetic material such as SUS 304 in order to keep unperturbed the magnetic field generated for plasma generation.

Preferably, the vacuum chamber 102 which is used to form the carbon protective layer 90 has pump-down means and presents such a seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Pump-down means 112 is provided for the vacuum chamber 102 and a preferred example is the combination of a rotary pump, a mechanical booster pump and a turbomolecular pump; pump-down means using a diffusion pump or a cryogenic pump may be suitably used instead of the turbomolecular pump. The performance and number of pump-down means 112 may be determined as appropriate for various factors including the capacity of the vacuum chamber 102 and the nature and flow rate of a gas used during film deposition. In order to adjust the pumping speed, various adjustment designs may be employed, such as bypass pipes that provide for evacuation resistance adjustment and orifice valves which are adjustable in the degree of opening.

Those sites of the vacuum chamber 102 where plasma develops or an arc is produced by plasma generating electromagnetic waves may be covered with an insulating member, which may be made of insulating materials including MC nylon, Teflon (PTFE), polyphenylene sulfide (PPS), polyethylene naphthalate (PEN) and polyethylene terephthalate (PET). If PEN or PET is used, care must be taken to insure that the degree of vacuum will not decrease upon degassing of such insulating materials.

The CVD apparatus 100 comprises the gas introducing section 104 consisting of two parts 104*a* and 104*b*, the former being a site for introducing a plasma generating gas and the latter for introducing a reactive gas, into the vacuum chamber 102 through stainless steel pipes or the like that are vacuum sealed with O-rings or the like. The amounts of the gases being introduced are controlled by known means such as a mass flow controller.

Both gas introducing parts 104*a* and 104*b* are basically so adapted as to displace the introduced gases to the neighborhood of the plasma-generating region in the vacuum chamber 102. The blowout position, particularly that of the reactive gas introducing part 104*b*, has a certain effect on the thickness profile of the carbon protective layer to be formed and, hence, it is preferably optimized in accordance with various factors such as the geometry of the substrate (the glaze of the thermal head 66).

Examples of the plasma generating gas for producing the carbon protective layer 90 are inert gases such as helium, neon, argon, krypton and xenon, among which argon gas is used with particular advantage because of price and easy availability. Examples of the reactive gas for producing the carbon protective layer 90 are the gases of hydrocarbon compounds such as methane, ethane, propane, ethylene, acetylene and benzene.

It is required with the gas introducing parts 104*a* and 104*b* that the sensors in the mass flow controllers be adjusted (calibrated) in accordance with the gases to be introduced.

In plasma-assisted CVD to form the carbon protective layer 90, the plasma generating means may utilize various discharges such as direct current (DC) glow discharge, radio-frequency (RF) discharge, DC arc discharge and microwave ECR discharge, among which DC arc discharge and microwave ECR discharge have high enough plasma densities to be particularly advantageous for high-speed film deposition.

The illustrated CVD apparatus 100 utilizes microwave ECR discharge and the plasma generating means 106 comprises a microwave source 114, magnets 116, a microwave guide 118, a coaxial transformer 120, a dielectric plate 122 and a radial antenna 124 and the like.

In DC glow discharge, a plasma is generated by applying a negative DC voltage between the substrate and the electrode. The DC power supply for use in DC glow discharge has an output of about 1 to 10 kW and a device having the necessary and sufficient output to produce the carbon protective layer 90 may appropriately be selected. For anti-arc and other purposes, a DC power supply pulse-modulated for 2 to 20 kHz is also applicable with advantage.

In RF discharge, a plasma is generated by applying a radio-frequency voltage to the electrodes via a matching box, which performs impedance matching such that the reflected wave of the radio-frequency voltage is no more than 25% of the incident wave. A suitable RF power supply for RF discharge may be selected from those in commercial use which produce outputs at 13.56 MHz having powers in the range from about 1 kW to about 10 kW which are necessary and sufficient to produce the carbon protective layer 90. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10 to 200 A having powers in the range from about 1 kW to about 10 kW which are necessary and sufficient to produce the carbon protective layer 90.

In microwave ECR discharge, a plasma is generated by the combination of microwaves and an ECR magnetic field and, as already mentioned, the illustrated CVD apparatus 100 utilizes microwave ECR discharge for plasma generation.

The microwave source 114 may appropriately be selected from those in commercial use which produce outputs at 2.45 GHz having powers in the range from about 1 kW to 3 kW which are necessary and sufficient to produce the carbon protective layer 90.

To generate an ECR magnetic field, permanent magnets or electromagnets which are capable of forming the desired magnetic field may appropriately be employed and, in the illustrated case, Sm-Co magnets are used as the magnets 116. Consider, for example, the case of using microwaves at 2.45 GHz; since the ECR magnetic field has a strength of 875 G (gauss), the magnets 116 may be those which produce a magnetic field with intensities of 500 to 2,000 G in the plasma generating region.

Microwaves are introduced into the vacuum chamber 102 using the microwave guide 118, the coaxial transformer 120, the dielectric plate 122, etc. It should be noted that the state of magnetic field formation and the microwave introducing path, both affecting the thickness profile of the carbon protective layer 90 to be deposited, are preferably optimized to provide a uniform thickness for the carbon protective layer 90.

The substrate holder 108 fixes the thermal head 66 to which the heat sink 67 is fixed or not fixed, or the glaze and other portions detached from the thermal head 66, by known fixing means such as a clamp or a jig in such a way that the glaze used as the substrate of film deposition is held in a face-to-face relationship with the radial antenna 124. If necessary, the glaze may be adapted to be rotatable or otherwise movable relative to the plasma generating means 106.

The distance between the substrate (the surface of the glaze) and the radial antenna 124 (the plasma generating section) is not limited to any particular value and a distance that provides a uniform thickness profile may be set appropriately within the range from about 20 mm to about 200 mm.

When forming the carbon protective layer 90, a mask for controlling the film deposition area may be used if necessary. Then, a plate-like masking member made of a metal such as SUS 304 or aluminum, or a resin such as Teflon or the like may be prepared and used for masking the areas to be protected from film deposition.

In order to form the carbon protective layer by plasma-assisted CVD, film deposition has to be performed with a negative bias voltage being applied to the substrate. The substrate bias source 110 is used to supply the required bias voltage.

The radio-frequency voltage is not limited to the self-bias voltage, but the latter is preferably used, since the carbon protective layer 90 has a high electrical resistance. The self-bias voltage is a negative DC component produced when applying a radio-frequency voltage in the plasma. When forming the carbon protective layer, the self-bias voltage in the range of −100 to −500 V is usually used. A suitable RF power supply may be selected from those in commercial use which produce outputs at 13.56 MHz having powers in the range from about 1 kW to about 5 kW.

When applying a radio-frequency voltage to the substrate, a matching box is preferably used for impedance matching between the substrate and the RF power supply. The matching box may be of manual control type or automatic control type and a variety of commercially available products can be used.

Instead of the radio-frequency self-bias voltage, a DC power supply pulse-modulated for 2 to 20 kHz is also applicable. In this case, the voltage to be applied is also in the range of from −100 to −500 V.

The surface of the substrate (glaze), or the surface of the illustrated lower protective layer 88 is preferably etched with a plasma prior to the formation of the carbon protective layer 90 in order to improve its adhesion to the carbon protective layer 90.

The etching methods include a method in which a radio-frequency voltage is applied via the matching box while generating a plasma by said plasma generating means 106, and a method in which a plasma is directly generated by a radio-frequency voltage and is used for etching.

A suitable RF power supply may be selected from those in commercial use which produce outputs at 13.56 MHz having powers in the range from about 1 kW to about 5 kW. The intensity of etching may be determined with the bias voltage to the substrate being used as a guide;, an optimal value may be selected from the range of −100 to −500 V.

Figure 5:
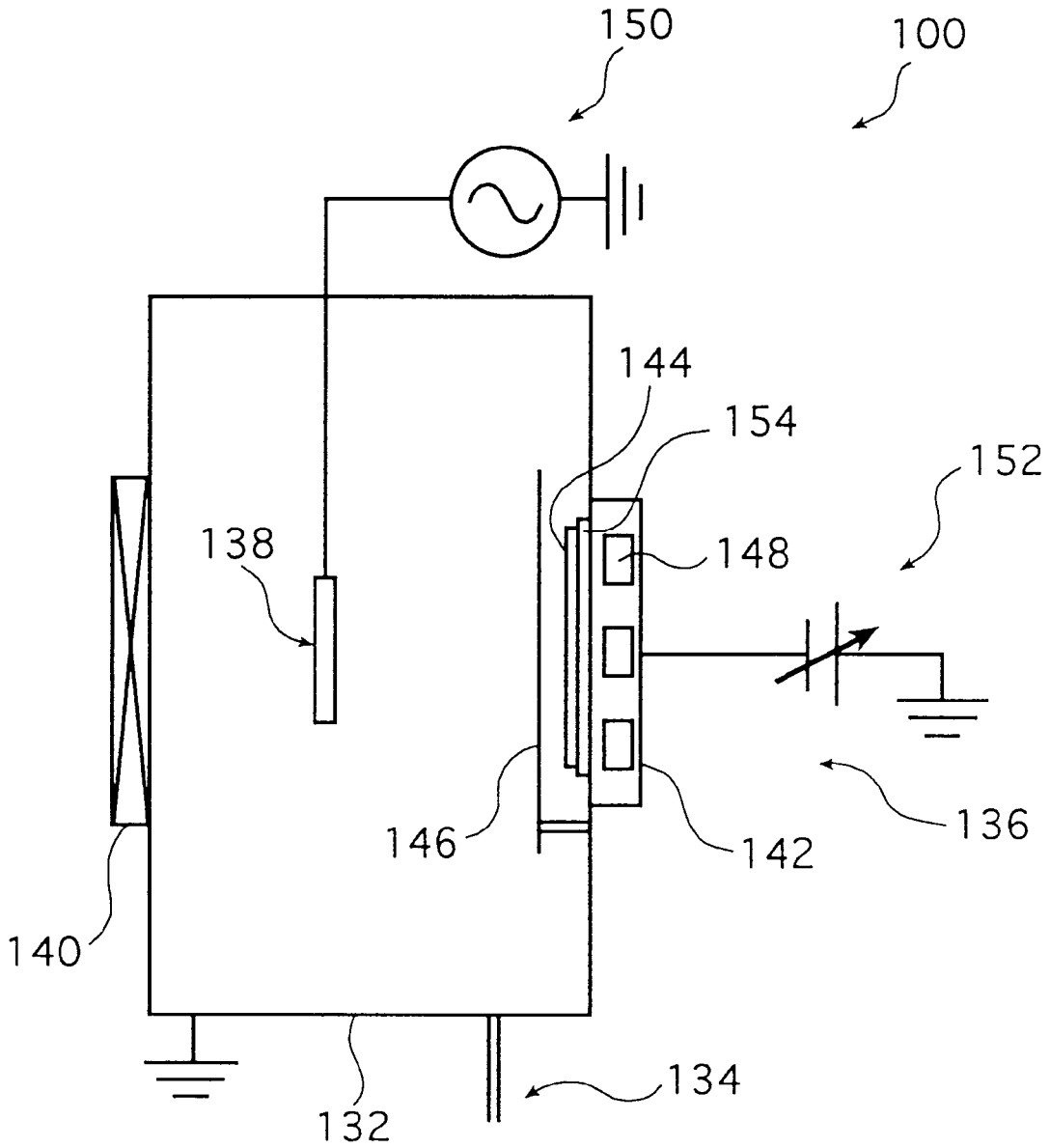
FIG. 5 shows the concept of an exemplary sputtering apparatus for forming a carbon protective layer on the thermal head of the invention.

FIG. 5 shows the concept of a sputtering apparatus to form the carbon protective layer 90.

The sputtering apparatus generally indicated by 130 comprises a vacuum chamber 132, a gas introducing section 134, sputter means 136 and a substrate holder 138 as the basic components.

The vacuum chamber 132 in which sputtering is performed to form the carbon protective layer, pump-down means 140 provided therefor, and adjusting means for pumping speed are advantageously exemplified by those having a similar structure to that of said CVD apparatus 100.

The gas introducing section 134 is a site for introducing a plasma generating gas into the vacuum chamber 132 through stainless steel pipes or the like that are vacuum sealed with O-rings or the like, as in the gas introducing section 104 of said CVD apparatus 100. The amounts of the gases being introduced are controlled by known means such as a mass flow controller. The gas introducing section 134 is basically so adapted as to displace the introduced gas to the neighborhood of the plasma-generating region in the vacuum chamber 132. The blowout position is preferably optimized to be such that the profile of the generated plasma will not be adversely affected.

To effect sputtering, a target 144 to be sputtered is placed on the cathode 142, which is rendered at negative potential and a plasma is generated on the surface of the target 144, whereby atoms are struck out of the target 144 and deposit on the surface on the opposed substrate (i.e., on the surface of the glaze of the thermal head 66=on the surface of the lower protective layer 88) to form the film.

The sputter means 136 comprises essentially the cathode 142, the area where the target 144 is to be placed, a shutter 146 and a DC power supply 152.

In order to generate a plasma on the surface of the target 144, the negative side of the DC power supply 152 is connected directly to the cathode 142, which is supplied with a DC voltage of about −300 to −1,000 V. The DC power supply 152 has an output of about 1 to 10 kW and a device having the necessary and sufficient output to produce the carbon protective layer 90 may appropriately be selected. The geometry of the cathode 142 may be determined as appropriate for various factors such as the geometry of the substrate on which the carbon protective layer 90 is to be formed. For anti-arc and other purposes, a negative DC power supply pulse-modulated for 2 to 20 kHz is also applicable with advantage.

RF power supplies are also useful to generate plasmas. If an RF power supply is to be used, a radio-frequency voltage is applied to the cathode 142 via a matching box so as to generate a plasma. The matching box performs impedance matching such that the reflected wave of the radio-frequency voltage is no more than 25% of the incident wave. A suitable RF power supply may be selected from those in commercial use which produce outputs at 13.56 MHz having powers in the range of from about 1 kW to about 10 kW which are necessary and sufficient to produce the carbon protective layer 90.

The target 144 may be secured directly to the cathode 142 with In-based solder or by mechanical fixing means but usually a backing plate 154 made of oxygen-free copper, stainless steel or the like is first fixed to the cathode 142 and the target 144 is then attached to the backing plate 154 by the methods just described above. The cathode 142 and the backing plate 154 are adapted to be water-coolable so that the target 144 is indirectly cooled with water.

The target 144 used to form the carbon protective layer 90 is preferably made of sintered carbon, glassy carbon or the like. The geometry of the target 114 may be determined as appropriate for the geometry of the substrate.

Another method that can advantageously be employed to form the carbon protective layer 90 is magnetron sputtering, in which magnets 148 such as permanent magnets or electromagnets are placed within the cathode 142 and a sputtering plasma is confined within a magnetic field formed on the surface of the target 144. Magnetron sputtering is preferred since it achieves high deposition rates.

The shape, position and number of the permanent magnets or electromagnets to be used and the strength of the magnetic field to be generated are determined as appropriate for various factors such as the thickness and its profile of the carbon protective layer 90 to be formed and the geometry of the target 144. Using permanent magnets such as Sm-Co and Nd-Fe-B magnets which are capable of producing intense magnetic fields is preferred for several reasons including the high efficiency of plasma confinement.

The substrate holder 138 is basically the same as the substrate holder 108 positioned in the CVD apparatus 100 described above and fixes the thermal head 66 in position so that the glaze is held in a predetermined face-to-face relationship with the cathode 142.

The distance between the substrate and the target 144 is not limited to any particular value and a distance that provides a uniform thickness profile may be set appropriately within the range from about 20 mm to about 200 mm.

A negative bias voltage is applied to the substrate (the lower protective layer 88 in the illustrated case) to obtain the carbon protective layer 90. A bias source 150 is used to supply the required bias voltage.

The bias voltage is not limited to any particular type but a radio-frequency self-bias voltage is preferably used as in the CVD described above. The RF power supply as used in the CVD is applicable and the matching box is also preferably used. Instead of the radio-frequency self-bias voltage, a DC power supply pulse-modulated for 2 to 20 kHz is also applicable with advantage. In this case, the voltage to be applied is also in the range of from −100 to −500 V.

When forming the carbon protective layer 90, the surface of the lower protective layer 88 is preferably etched with a plasma prior to the formation of the carbon protective layer 90 in order to improve its adhesion to the lower layer (lower protective layer 88).

The etching methods include a method in which a radio-frequency voltage is applied to the substrate via the matching box while generating a plasma, and a method in which a plasma is directly generated by a radio-frequency voltage and is used for etching. The plasma generating means and the RF power supply as described above can be used. The intensity of etching may be determined with the bias voltage to the substrate being used as a guide; usually, an optimal value may be selected from the range of −100 to −500 V.

On the foregoing pages, the thermal head has been described in detail but the present invention is in no way limited to the stated embodiments and various improvements and modifications can of course be made without departing from the spirit and scope of the invention.

As described above in detail, the present invention provides a thermal head in which corrosion and wear of the protective film, and the resistance variation of the heating elements due to thermal recording were significantly reduced, and which has a sufficient durability and stability with the passage of time to perform thermal recording of high-quality images in a consistent manner over an extended period of operation.

The invention will be further illustrated by means of the following specific examples.

EXAMPLE 1

Supply of Heating History:

A commercial thermal head (Model KGT-260-12MPH8 of KYOCERA CORP.) was used as the base. The thermal head had a silicon nitride ($Si_3N_4$) film formed in a thickness of 11 $\mu$m as a protective layer on the surface of the glaze. Therefore, in Example 1, the silicon nitride film served as the lower protective layer 88.

All the heating elements of the thermal head were provided with heating histories by continuously supplying heat generating energy of 145 mJ/mm$^2$ for 90 minutes. The resistance values of all the heating elements in the thermal head were then reduced by about 1.5% on average.

The carbon protective layer 90 was formed on the surface of the glaze of the thermal head which was thus provided with the heating history, by means of the plasma-assisted CVD apparatus shown in FIG. 4 to thereby fabricate the thermal head 66 having the glaze shown in FIG. 2.

The plasma-assisted CVD apparatus 100 is now described in detail.

a. Vacuum Chamber 102

This vacuum chamber was made of SUS 304 and had a capacity of 0.5 m$^3$; pump-down means 112 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 104

This gas introducing section was composed of a mass flow controller permitting a maximum flow rate of 100 to 500 sccm and a stainless steel pipe having a diameter of 6 mm. The joint between the stainless steel pipe and the vacuum chamber 102 was vacuum sealed with an O-ring.

Argon gas was used as a plasma generating gas.

c. Plasma Generating Means 106

A microwave ECR plasma generating apparatus using a microwave source 114 oscillating at a frequency of 2.45 GHz and producing a maximal output of 3.0 kW was employed. The generated microwave was guided to the neighborhood of the vacuum chamber 102 by means of the microwave guide 118, passed through the coaxial transformer 120 and directed to the radial antenna 124 in the vacuum chamber 102.

The dielectric plate 122 used was in a rectangular form having a width of 800 mm and a height of 200 mm. The microwave passing through the microwave guide 118 was divided into four on the halfway and introduced into the vacuum chamber 102 through 4 portions in the dielectric plate 122.

A magnetic field for ECR was produced by arranging a plurality of Sm-Co magnets used as the magnets 116 in a pattern to conform to the shape of the dielectric plate 122.

d. Substrate Holder 108

The substrate (that is, the glaze 82 of the thermal head 66; see FIG. 2) was held in a face-to-face relationship with the plasma generating section and was so adapted that the distance between the substrate and the radial antenna 124 could be varied between 50 mm and 150 mm.

That area of the substrate in which the thermal head was held was set at a floating potential in order to enable the application of an etching radio-frequency voltage.

e. Substrate Bias Source 110

An RF power supply served as the substrate bias source 110 was connected to the substrate holder 108 via a matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In the CVD apparatus 100, the substrate bias source 110 also serves as the substrate etching means.

Fabrication of Thermal Head 66:

Thermal head 66 was secured to the substrate holder 108 in the vacuum chamber 102 such that the glaze 82 of the thermal head 66 provided with the heating history as described above would be in a face-to-face relationship with the radial antenna 124. The distance between the substrate (surface of the glaze 82) and the radial antenna 124 was set to 100 mm. All areas of the thermal head other than those where the carbon protective layer was to be formed (namely, the non-glaze areas) were previously masked.

After the thermal head was fixed in position, the vacuum chamber 102 was pumped down to an internal pressure of $5\times10^{-6}$ Torr.

With continued pump-down, argon gas was introduced through the gas introducing section 104*a* and the pressure in the vacuum chamber 102 was adjusted to $1.0\times10^{-3}$ Torr by means of the orifice valve fitted on the turbomolecular pump.

Subsequently, the microwave source 114 was driven to introduce each microwave at a power of 400 W through 4 portions in the dielectric plate into the vacuum chamber 102 where a microwave ECR plasma was generated. The substrate bias source 110 was also driven to apply a radio-frequency bias voltage to the substrate and the lower protective layer 88 (silicon nitride film) was etched for 2 minutes at a self-bias voltage of −200 V.

After the end of etching, the plasma-assisted CVD was performed by introducing methane gas to adjust the internal pressure in the vacuum chamber 102 at $3.0\times10^{-3}$ Torr, with the radio-frequency voltage being kept applied by the self-bias voltage. Thus, the thermal head 66 having the carbon protective layer 90 formed in a thickness of 1 $\mu$m was fabricated. The same procedure was repeated to fabricate two additional samples of thermal head having the carbon protective layer 90 formed in thickness of 2 $\mu$m and 3 $\mu$m.

To control the thickness of the carbon protective layer 90 being formed, the deposition rate was determined previously and the time required to reach a specified film thickness was calculated.

Evaluation of Performance:

Using the thus fabricated thermal head and sheets of thermal material (dry image recording film CR-AT of Fuji Photo Film Co., Ltd.), a thermal recording test was performed. The results showed that normal thermal image recording could be performed.

Comparative Example 1

The procedure of Example 1 was repeated to fabricate additional three samples of thermal head having the carbon protective layer 90 deposited thereon in thickness of 1 $\mu$m, 2 $\mu$m and 3 $\mu$m, except that the formation of the carbon protective layer and the supply of the heating history to each of the heating elements were reversed, that is, the formation of the carbon protective layer was followed by the supply of heating history to each of the heating elements.

After the supply of heating history, the resistance values of all the heating elements were reduced by about 1.5% on average.

The thus fabricated samples of thermal head were used to perform an image recording test as in Example 1. In this example, extreme density unevenness or streaks were confirmed on the image. The surface of the glaze in each thermal head was observed by means of a light microscope. Change of properties due to heat was confirmed in the carbon protective layer.

These results clearly demonstrate the effectiveness of the present invention.

What is claimed is:

1. A thermal head comprising:

heating elements which were provided with heating histories to previously change their resistance values by predetermined values; and a carbon-based protective layer which was formed after said heating elements were provided with said heating histories.

2. The thermal head according to claim 1, wherein an amount of the resistance variation to be previously given to said heating elements by said heating histories is in the range of from 0.1 to 5.0%.

3. The thermal head according to claim 1, wherein an amount of the resistance variation to be previously given to said heating elements by said heating histories is in the range of from 0.5 to 2.0%.

4. The thermal head according to claim 1, wherein said heating histories are provided in blank recording by supplying a specified amount of heat generating energy for a specified period of time without recording on a thermal material.

5. The thermal head according to claim 1, wherein said carbon-based protective layer is a carbon protective layer containing more than 50 atm % of carbon.

6. The thermal head according to claim 1, wherein said carbon-based protective layer is a high-purity carbon protective layer.

7. The thermal head according to claim 1, wherein said carbon-based protective layer has a Vickers hardness of 2000 kg/mm$^2$ or more.

8. The thermal head according to claim 1, wherein said carbon-based protective layer has a Vickers hardness of 2500 kg/mm$^2$ or more.

9. The thermal head according to claim 1, wherein said carbon-based protective layer has a thickness of from 1 to 20 $\mu$m.

10. The thermal head according to claim 1, wherein said carbon-based protective layer has a thickness of from 2 to 10 $\mu$m.

11. The thermal head according to claim 1, wherein said thermal head further comprises at least one ceramic-based protective layer as a lower protective layer of said carbon-based protective layer on the side of the heating elements.

12. The thermal head according to claim 11, wherein said ceramic-based protective layer is a protective layer made of a material selected from the group consisting of silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures of at least two of these materials.

13. The thermal head according to claim 11, wherein said ceramic-based protective layer is a protective layer made of a material selected from the group consisting of silicon nitride, silicon carbide, SIALON and mixtures of at least two of these materials.

14. The thermal head according to claim 11, wherein said lower protective layer has a thickness of from 0.5 to 50 $\mu$m.

15. The thermal head according to claim 11, wherein said lower protective layer has a thickness of from 2 to 20 $\mu$m.

16. The thermal head according to claim 11, wherein said carbon-based protective layer has a thickness of from 0.1 to 5 $\mu$m.

17. The thermal head according to claim 11, wherein said carbon-based protective layer has a thickness of from 1 to 3 $\mu$m.

* * * * *

UNITED STATES PATENT AND TRADEMARK OFFICE

CERTIFICATE OF CORRECTION

PATENT NO. : 6,002,418
DATED : December 14, 1999
INVENTOR(S) : Junichi YONEDA, et al.

It is certified that error appears in the above-identified patent and that said Letters Patent is hereby corrected as shown below:

Claim 1, line 2, delete "were" and insert --are--;
Claim 1, line 5, delete "was" and insert --is--; and
Claim 1, line 6, delete "were" and insert --are--.

Signed and Sealed this

Tenth Day of April, 2001

*Attest:*

Nicholas P. Godici

NICHOLAS P. GODICI

*Attesting Officer*

*Acting Director of the United States Patent and Trademark Office*